US005527119A

United States Patent [19]

Kaneuchi et al.

[11] Patent Number: 5,527,119

[45] Date of Patent: Jun. 18, 1996

[54] INK RIBBON MECHANISM

[75] Inventors: Noboru Kaneuchi; Tsutomu Tanimoto; Kiyoshi Shimada; Hitoshi Moriyama, all of Kanagawa, Japan

[73] Assignee: Fujitsu Limited, Kawasaki, Japan

[21] Appl. No.: 434,364

[22] Filed: May 5, 1995

[30] Foreign Application Priority Data

Jul. 28, 1994 [JP] Japan ..... 6-177109

[51] Int. Cl.[6] ..... B41J 33/26

[52] U.S. Cl. ..... 400/235.1; 400/248

[58] Field of Search ..... 400/235, 235.1, 400/192, 194, 196, 196.1, 208, 248, 248.3

[56] References Cited

U.S. PATENT DOCUMENTS

| | | | |
|---|---|---|---|
| 4,343,556 | 8/1982 | Kobayashi | 400/235.1 |
| 5,354,138 | 10/1994 | Daggs | 400/235 |

FOREIGN PATENT DOCUMENTS

| | | | |
|---|---|---|---|
| 59-35970 | 2/1984 | Japan . | |
| 59-102363 | 7/1984 | Japan . | |
| 61-219680 | 9/1986 | Japan . | |
| 62-167064 | 7/1987 | Japan . | |
| 62-183373 | 8/1987 | Japan . | |
| 1-193863 | 3/1989 | Japan . | |
| 1-78874 | 3/1989 | Japan . | |
| 2-172783 | 7/1990 | Japan . | |
| 249678 | 10/1990 | Japan | 400/197 |
| 3-147880 | 6/1991 | Japan . | |
| 3-158280 | 7/1991 | Japan . | |
| 3-284976 | 12/1991 | Japan . | |
| 4-208485 | 7/1992 | Japan . | |

*Primary Examiner*—Ren Yan
*Attorney, Agent, or Firm*—Armstrong, Westerman, Hattori, McLeland & Naughton

[57] ABSTRACT

A pair of feed rollers for sending an ink ribbon into a ribbon case have a number of grooves on the circumferential faces thereof such that opposed grooves do not mesh with each other. A heater is disposed in a travel path for the ink ribbon, for heating the ink ribbon to prevent deterioration of the drawability of the ink ribbon drawn by the pair of feed rollers.

11 Claims, 11 Drawing Sheets

INK RIBBON MECHANISM

FIELD OF THE INVENTION

The present invention relates to an ink ribbon mechanism, and more particularly, to an ink ribbon mechanism for steadily sending a loop of ink ribbon into a ribbon case that is set in a printer such as an impact printer.

DESCRIPTION OF THE RELATED ART

In a printer (e.g. impact printer) used as an output device for a computer or other devices, an endless ribbon that is a ribbon impregnated with ink (i.e., ink ribbon) whose ends are butted together is used. Most of such an endless ribbon is housed in a ribbon case, being folded in the form of bellows. After the ribbon has been drawn off from one end of the ribbon case and fed to a position between a print head and a platen, it is sent back to the other end of the ribbon case, while being held between a pair of feed rollers.

As the pair of feed rollers described above, rollers made from elastic material such as synthetic rubber are generally used in order to achieve satisfactory holding capability against the ink ribbon. However, such rubber rollers disadvantageously become hardened, loosing their elasticity at low temperatures, which causes the ink ribbon to slip when it is drawn. To prevent slipping of the ink ribbon, an attempt has been made in which a drive roller 51 and idler roller 52 are respectively provided with point-shaped teeth 53 having either triangular or involute shape as shown in FIG. 16 and these teeth 53 are meshed with one another thereby holding an ink ribbon 54 therebetween to send into a ribbon case.

SUMMARY OF THE INVENTION

The rollers shown in FIG. 16 also suffer from the disadvantage that since the teeth 53 of the rollers 51 and 52 are in mesh, the substrate of the ink ribbon 54 is likely to get creases when it is sent into the ribbon case. This causes the ink ribbon 54 to be accommodated in an irregularly corrugated fashion inside the ribbon case 55 as shown in FIG. 17, with an increased apparent volume of the ink ribbon 54. As a result, a ribbon jam occurs owing to this inadequate accommodating condition.

The present invention takes these problems into account, and one of the objects of the present invention is therefore to provide an ink ribbon mechanism that is capable of preventing an ink ribbon from being sent into a ribbon case in an inadequate condition when temperature is low, so that the ink ribbon to be accommodated in the ribbon case can be made more compact.

This object is achieved by the present invention. According to a first aspect of the invention, there is provided an ink ribbon mechanism for sending a loop of ink ribbon into a ribbon case by means of a pair of feed rollers, in which the pair of feed rollers have a number of grooves on the circumferential faces thereof such that opposed grooves do not mesh with each other.

In the first form of the ink ribbon mechanism of the invention, the ink ribbon is drawn by the pair of feed rollers and as a result of the friction occurring between the ink ribbon and either of the feed rollers, the ink ribbon is caught on the circumferential face of the feed roller and sent towards a side wall of the ribbon case. Striking upon the side wall, the ink ribbon bends and turns in the opposite direction. Thereafter, the ink ribbon is caught on the circumferential face of the other feed roller and then sent towards the other side wall of the ribbon case. Accordingly, the ink ribbon sent into the ribbon case is folded sequentially between the two side walls and accommodated in the ribbon case. With this arrangement, even if the feed rollers become hardened at low temperatures, causing a decrease in the friction between the ink ribbon and the feed rollers, the ink ribbon is hooked on the edges of the grooves of the feed rollers and therefore advances steadily in spite of the decrease of the friction. In addition, the feed rollers are so designed that opposing grooves do not mesh with each other, which prevents the substrate of the ink ribbon from getting creases when the ink ribbon is sent into the ribbon case. As a result, inadequate accommodating condition due to the occurrence of creases can be avoided, which leads to an improvement in the compactness of the ink ribbon.

Preferably, the feed rollers may be formed by laminating a number of rolled bodies made from elastic material and the grooves are formed on all of the rolled bodies. Each groove is preferably formed so as to extend in an axial direction of the feed rollers.

According to a second aspect of the invention, there is provided an ink ribbon mechanism for sending a loop of ink ribbon into a ribbon case by means of a pair of feed rollers, comprising heating means disposed in a travel path for the ink ribbon, for heating the ink ribbon to prevent deterioration of the drawability of the ink ribbon drawn by the pair of feed rollers.

In the second embodiment of the ink ribbon mechanism, the ink ribbon and therefore the travel path are heated by the heating means disposed in the travel path for the ink ribbon, so that the feed rollers are prevented from being hardened even at low temperatures. This prevents a decrease in the friction between the feed rollers and the ink ribbon, thereby preventing deterioration of the drawability of the ink ribbon drawn by the feed rollers. As a result, an inadequate accommodating condition can be avoided.

The ink ribbon mechanism preferably further comprises temperature detecting means for detecting temperature in the vicinity of the travel path for the ink ribbon and heat controlling means for actuating the heating means when the temperature detected by the temperature detecting means is below a preset value.

According to a third aspect of the invention, there is provided an ink ribbon mechanism for sending a loop of ink ribbon into a ribbon case by means of a pair of feed rollers, in which the pair of feed rollers have a number of grooves at their circumferential faces such that opposed grooves do not mesh with each other and which comprises heating means disposed in a travel path for the ink ribbon, for heating the ink ribbon to prevent deterioration of the drawability of the ink ribbon drawn by the pair of feed rollers.

The third embodiment of the ink ribbon mechanism is provided with both of the functions of the first and second forms of the ink ribbon mechanism so that the synergistic effects of these functions further improve the compactness (i.e., foldability) of the ink ribbon.

In the third embodiment of the ink ribbon mechanism, the feed rollers may also be formed by laminating a number of rolled bodies made from elastic material and the grooves are formed on all of the rolled bodies. Each groove is preferably formed so as to extend in an axial direction of the feed rollers. Suitably, the ink ribbon mechanism further comprises temperature detecting means for detecting the temperature in the vicinity of the travel path for the ink ribbon and heat controlling means for actuating the heating means when the temperature detected by the temperature detecting means is below a preset value. Such arrangement prevents damage to the ink ribbon caused by unnecessary heating when temperature is not low.

As the heating means employed in the second and third forms of the ink ribbon mechanism, any of the following devices may be used.

(1) A heater incorporated in a ribbon guide that is disposed in the travel path for the ink ribbon, for guiding the ink ribbon.

(2) A heating unit disposed along the travel path for the ink ribbon so as to come in contact with the ink ribbon.

(3) A heating unit disposed along the travel path for the ink ribbon so as to heat atmospheric air in the vicinity of the ink ribbon.

(4) A warm-air generating unit disposed along the travel path for the ink ribbon so as to blow warm air to the ink ribbon.

(5) A heater incorporated in a ribbon case container for supporting the ribbon case.

(6) Heaters incorporated in the pair of feed rollers.

Other objects of the present invention will become apparent from the detailed description given hereinafter. However, it should be understood that the detailed description and specific example, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and accompanying drawings which are given by way of illustration only, and thus are not limitative of the present invention, and wherein:

FIG. 1 is a perspective view of a whole impact printer with a lid open, to which an ink ribbon mechanism according to one embodiment of the invention is applied;

FIG. 2 is a partial perspective view of the impact printer in which a ribbon case is about to be installed;

FIG. 3 is a partial plan view of the impact printer with the ribbon case installed;

FIG. 4 is a perspective view of a ribbon feed unit;

FIG. 5 is a perspective view of a ribbon feed sensor;

FIG. 6 is a perspective view of an essential part of the ribbon driving mechanism;

FIG. 7(*a*) is a plan view of feed rollers provided in the ribbon driving mechanism and FIG. 7(*b*) is an enlarged view of an essential part of the feed rollers;

FIG. 8 is a view illustrating the condition of an ink ribbon held on a rolled body;

FIG. 9 is a view illustrating the condition of the ink ribbon folded within the ribbon case;

FIG. 10 is a view illustrating the relationship between the friction occurring between the ink ribbon and rolled body and the friction occurring between parts of the ink ribbon;

FIG. 11 is a perspective view of a ribbon guide according to a second embodiment;

FIG. 12 is a flow chart of operation for controlling a heater;

FIG. 13 is a view of a modification of heating means;

FIG. 14 is a perspective view of another modification of the heating means;

FIG. 15 is a perspective view of a still further modification of the heating means;

FIG. 16 is a view illustrating the structure of prior art feed rollers; and

FIG. 17 is a view illustrating a problem in the prior art feed rollers.

DESCRIPTION OF THE PREFERRED EMBODIMENTS

Referring now to the accompanying drawings, preferred embodiments of an ink ribbon mechanism according to the invention will be described.

(First Embodiment)

Figure 1:
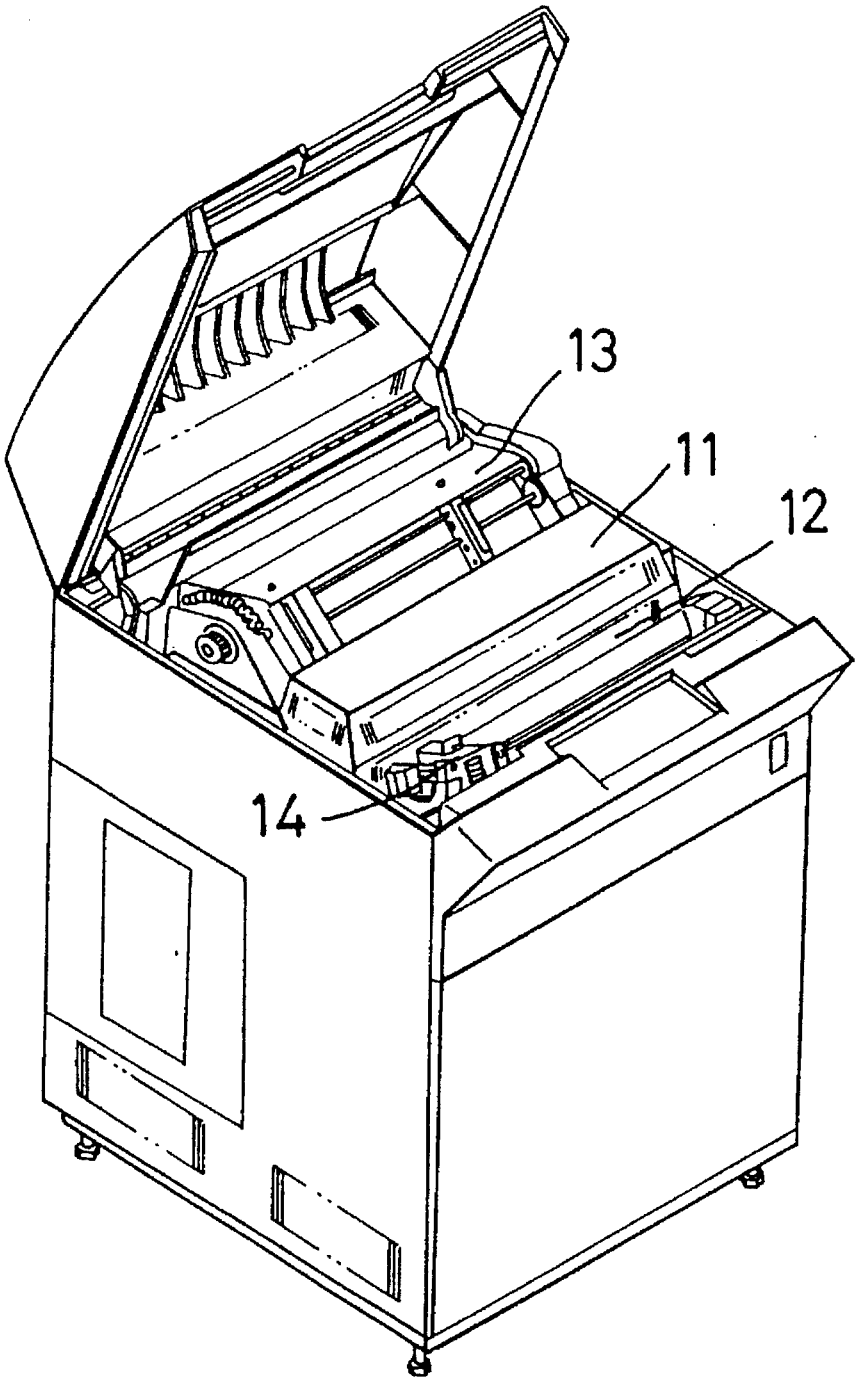
FIGS. 1 to 17 provide illustrations of preferred embodiments of an ink ribbon mechanism according to the invention.

FIG. 1 shows a perspective view of an impact printer having its lid open, to which an ink ribbon mechanism according to a first embodiment of the invention is applied. In the first embodiment, the impact printer comprises a printing unit 11 which is disposed on a base unit 12 and has a number of print heads; and a paper feed unit 13 for delivering a paper sheet (continuous sheet) to be printed to a position between a print head and platen of the printing unit 11. Disposed in front of the printing unit 11 is a ribbon unit 14 for feeding an ink ribbon to a position between a print head and the paper sheet.

Figure 2:
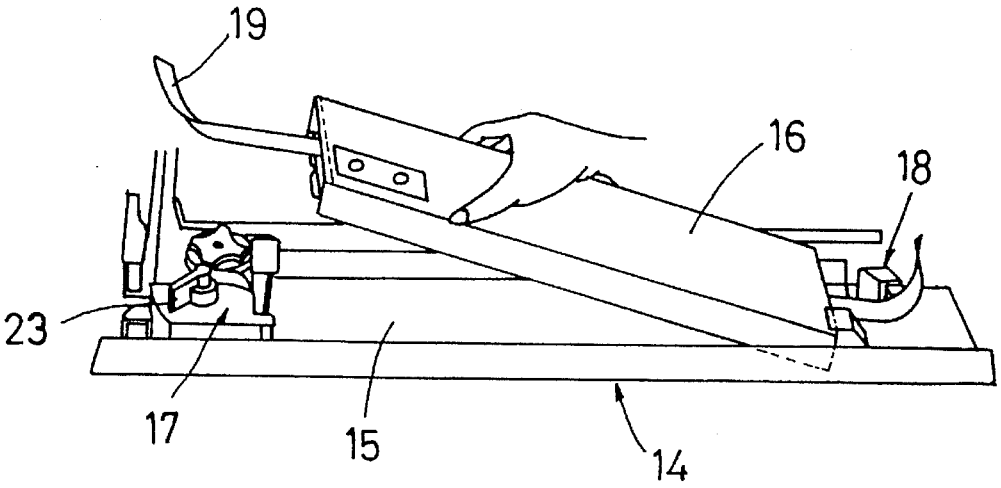
Figure 3:
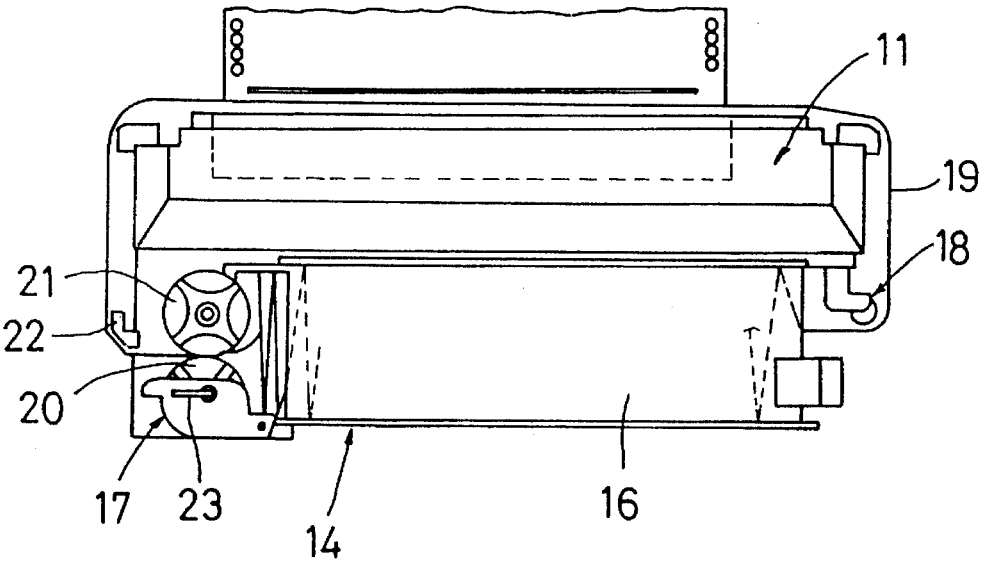
Figure 4:
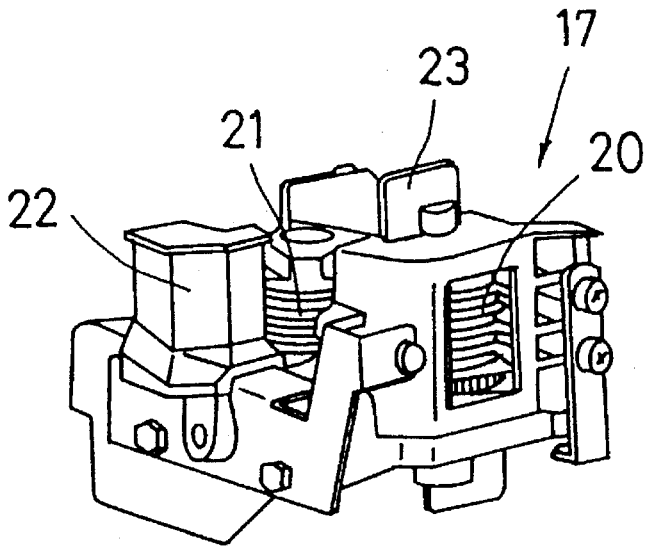
Figure 5:
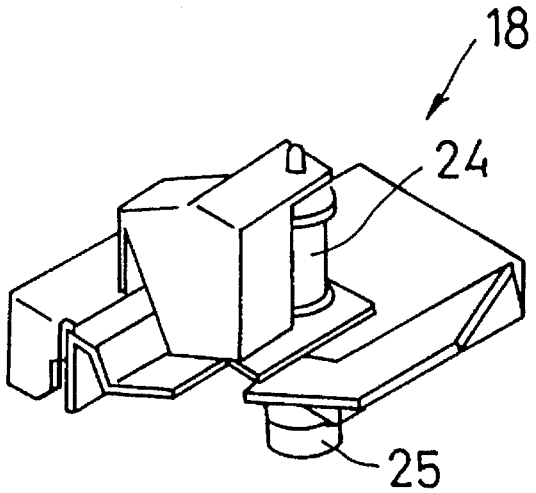

As shown in FIGS. 2 and 3, the ribbon unit 14 comprises a ribbon case container 15, ribbon feed unit 17 and ribbon feed sensor 18. The ribbon feed unit 17 is disposed on the inlet side of a cassette-type ribbon case 16 to be placed in the ribbon case container 15, while the ribbon feed sensor 18 is disposed on the outlet side of the ribbon case 16. In the ribbon case 16, most of an endless ink ribbon 19 is accommodated, being folded in the form of bellows. As shown in FIG. 4, the ribbon feed unit 17 comprises a ribbon driving mechanism composed of a pair of opposed feed rollers 20, 21 and a ribbon guide 22 adjacent the ribbon driving mechanism, the mechanism and the ribbon guide 22 being integrally formed. The first feed roller 20 is brought into or kept out of contact with the second feed roller 21 by means of a release lever 23. The ribbon feed sensor 18 comprises, as shown in FIG. 5, a ribbon check roller 24 that not only checks the feed condition of the ink ribbon 19 but also guides the ink ribbon 19 and a sensor part 25 for detecting the rotating condition of the ribbon check roller 24.

The ribbon case 16 is placed in the ribbon case container 15 as shown in FIG. 2, with the ink ribbon 19 being wound along a specified travel path, and then, the ink ribbon 19 is sandwiched between the pair of feed rollers 20, 21 by operation of the release lever 23, whereby the ink ribbon 19 is set in the body of the printer. When the ribbon driving mechanism is actuated in this set condition, the ink ribbon 19 drawn out from one end of the ribbon case 16 is fed to a position between the printer head and platen, passing through the ribbon feed sensor 18. Thereafter, the ink ribbon 16 is sent back into the ribbon case 16 from the other end thereof by means of the ribbon feed unit 17.

Figure 6:
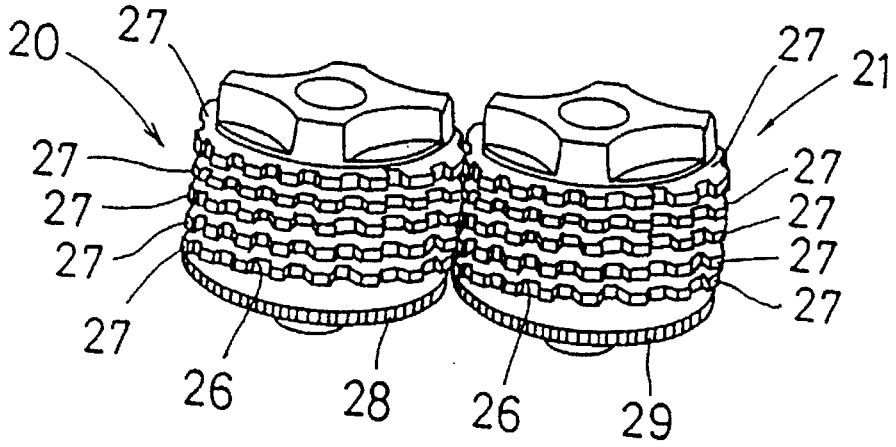
Figure 7A:
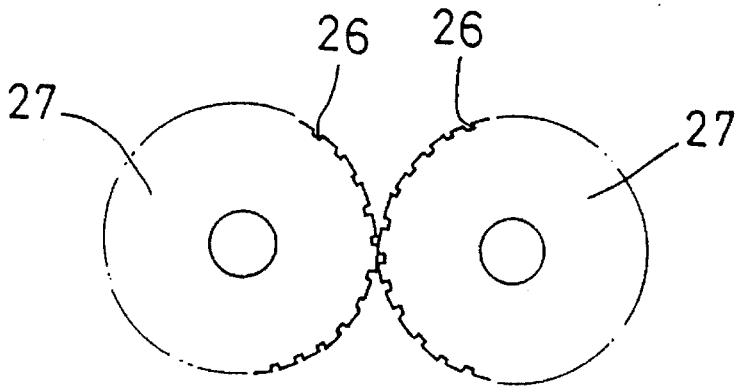
Figure 7B:
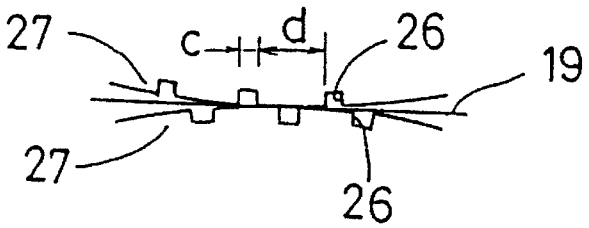

The structure of the ribbon driving mechanism will be described in detail with reference to FIGS. 6 and 7.

The feed rollers 20 and 21 which constitute the ribbon driving mechanism are made by laminating multiple layers (five layers in the embodiment shown in FIG. 6) of rolled body 27. These layers of rolled body 27 are made from elastic material (e.g., soft material such as rubber) and have at their circumferential faces a number of grooves 26 each of which extends in an axial direction of the rollers 20, 21. The feed rollers 20, 21 have, at one end thereof, toothed wheels 28, 29 which mesh with each other so that these rollers 20, 21 synchronously rotate in directions opposite to each other, either of the rollers 20, 21 functioning as a drive roller while the other functions as an idler roller. This allows the ink ribbon 19 to be forwarded, being sandwiched between the opposed rolled bodies 27. In this case, as shown in FIG. 7(*b*), the position of each rolled body 27 is arranged such that the width c of each groove 26 formed on the rolled bodies 27 is shorter than the distance d between successive grooves 26 (i.e., c <d)and such that the grooves 26 facing to each other are not brought into mesh.

Figure 8:
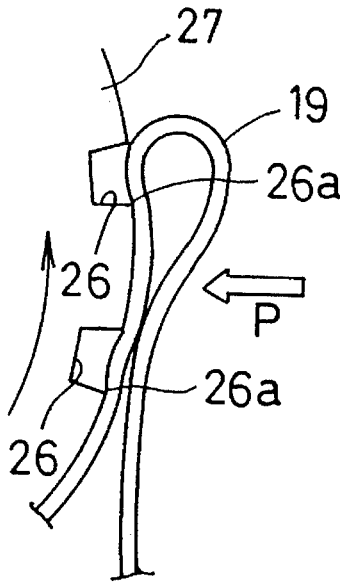
Figure 9:
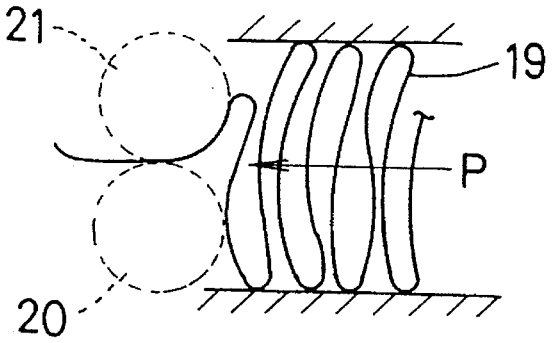
Figure 10:
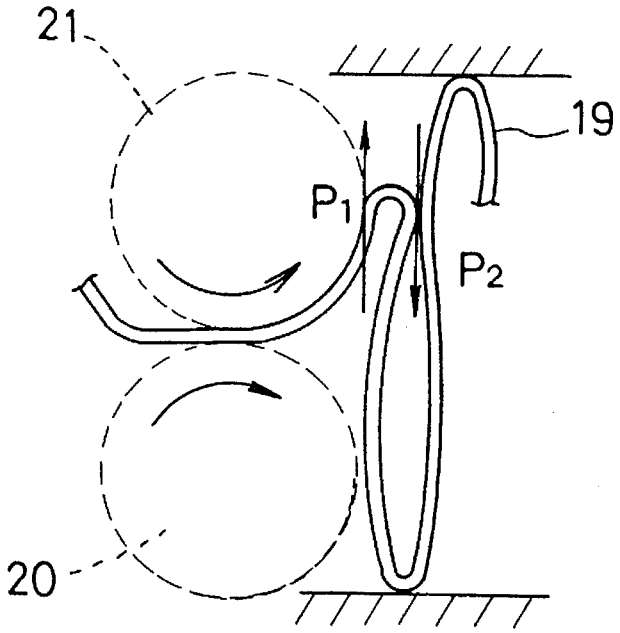
Figure 17:
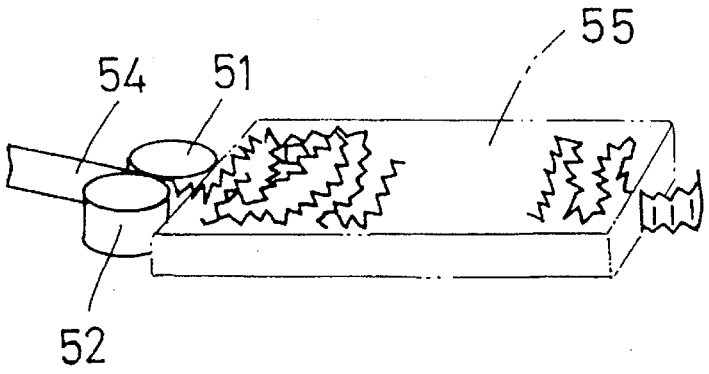
PRIOR ART FIG. 17

In such a ribbon driving mechanism, the grooves 26 and circumferential face portions therebetween in the rolled bodies 27 which face each other are not brought into mesh and therefore the substrate of the ink ribbon 19 does not get creases when the ink ribbon 19 is sent into the ribbon case 16. As a result, the ink ribbon 19 will not be accommodated in an irregularly corrugated fashion within the ribbon case 16 as shown in FIG. 17. The ink ribbon 19 drawn into the ribbon case 16 with the help of the rolled bodies 27 as shown in FIG. 8 is put into the grooves 26 because of the internal pressure P of the ink ribbon 19 accommodated in tile ribbon case 16 so that tile ink ribbon 19 is caught by the edges 26*a* of the grooves 26 in either of the feed rollers 20, 21 and sent towards one side wall of the ribbon case 16. Striking upon the side wall, the ink ribbon 19 bends and turns in the opposite direction. This allows the ink ribbon 19 to be caught by the edges 26*a* of the rolled bodies 27 in the other feed roller, and accordingly, the ink ribbon 19 is sent towards the other side wall of the ribbon case 16. In this way, the ink ribbon 19 is sequentially folded between the two side walls of the ribbon case 16 as shown in FIG. 9 and accommodated in the ribbon case 16. In order to continue such a folding action, the friction $P_1$ between the ink ribbon 19 and rolled bodies 27 as shown in FIG. 10 should be greater than the friction $P_2$ between parts of the ink ribbon 19 (i.e., $P_1>P_2$). In this embodiment, even if the hardness of the rolled bodies 27 increases at low temperatures, decreasing the friction $P_1$, the folding action can continue stably since the edges 26*a* of the grooves 26 catch the ink ribbon 19 as described earlier.

Although the first embodiment has been discussed with the pair of feed rollers 20, 21 that are provided in the body of the printer, the invention is equally applicable to the so-called ribbon cassette, that is, a ribbon case in which the feed rollers 20, 21 are incorporated.

(Second Embodiment)

The impact printer of the second embodiment has a structure substantially identical to that of the first embodiment, and therefore, the description of the parts that are substantially equivalent to those set forth in the first embodiment will be omitted and only the parts inherent to the second embodiment will be described.

Figure 11:
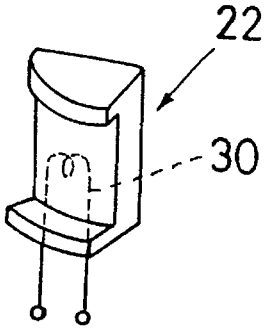
Figure 12:
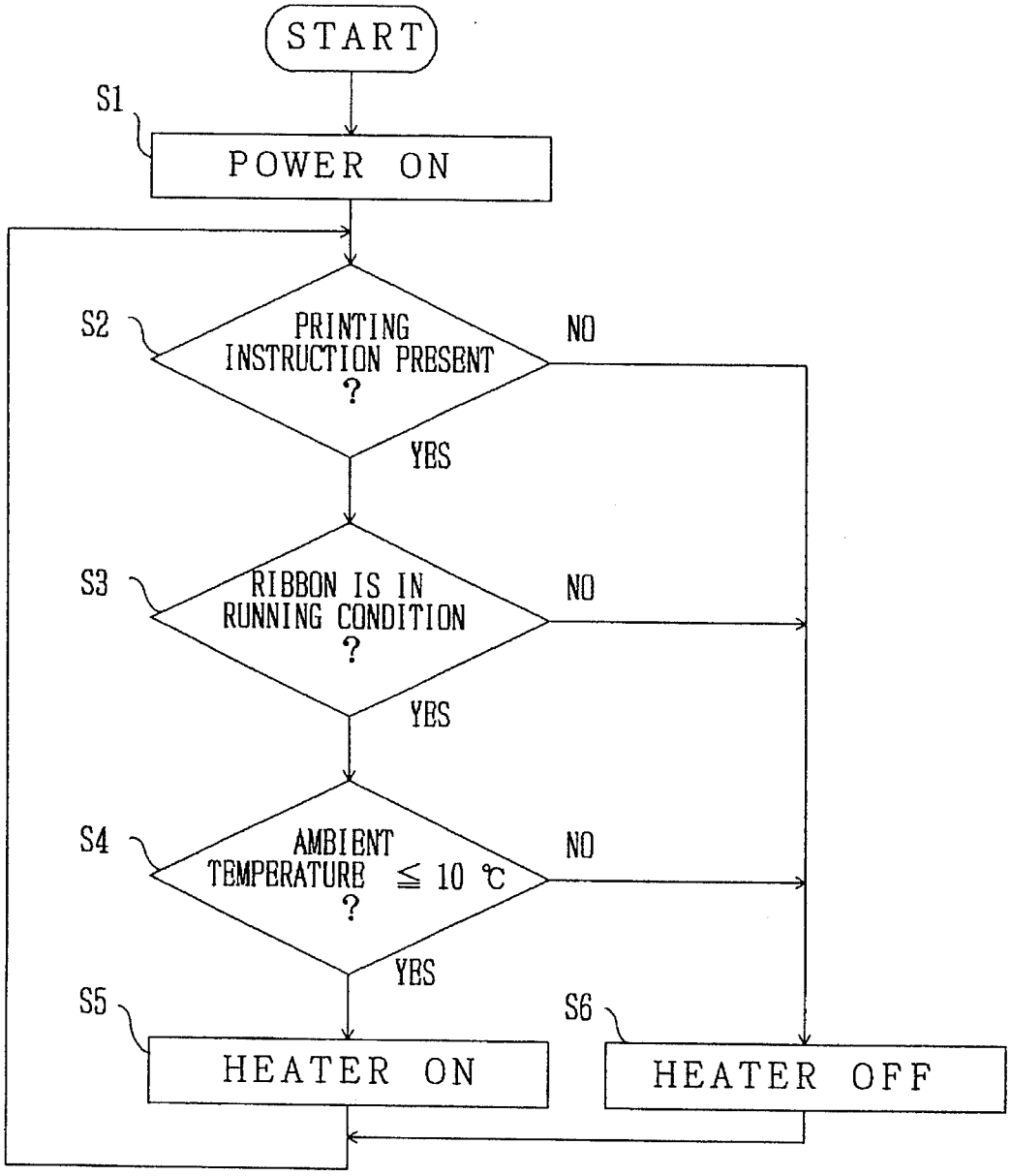

In this embodiment, a heater 30 is embedded as shown in FIG. 11 in the ribbon guide 22 (see FIGS. 3 and 4) that is provided in the travel path of the ink ribbon 19, in order to heat the travel path of the ink ribbon 19 thereby preventing deterioration of the drawability of the ink ribbon 19 drawn by the feed rollers 20, 21. The ON-OFF control of the heater 30 is performed based on the flow chart shown in FIG. 12. Next, this flow chart will be explained.

Figure 19:
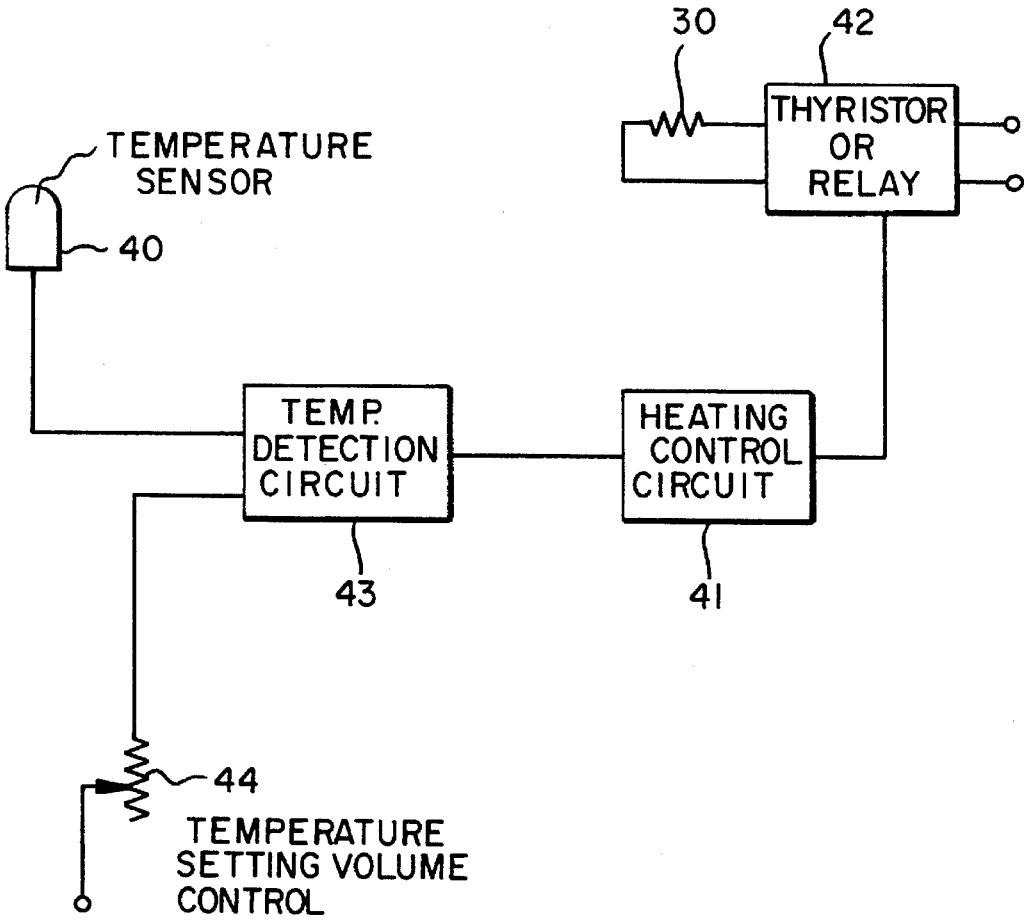
FIG. 19 is a diagram of the temperature detection circuit and heating control circuit of the present invention.

After the power switch has been turned on (S1), if a printing instruction is released (S2), if the ink ribbon 19 is detected to be in a traveling condition by the ribbon feed sensor 18 (S3) and if the ambient temperature is detected to be 10° C. or less by a temperature sensor 40 disposed in the vicinity of the travel path of the ink ribbon 19 (S4), the heater 30 is turned on via either a thyristor or relay 42 in response to an instruction sent from heating control circuit 41 (S5). If the printing instruction is not released, or the ink ribbon 19 is not in a traveling condition or the ambient temperature exceeds 10° C., the heater 30 is turned off (S6). Note that in FIG. 19, reference numeral 43 denotes a detection circuit for detecting the temperature of the vicinity of the travel path of the ink ribbon 19 as well as for setting a temperature for a condition in which the heater 30 is turned ON, and reference numeral 44 denotes a temperature setting volume.

With this arrangement, even when ambient temperature is 10° C. or less, hardening of the feed rollers 20, 21 is prevented by heating the travel path of the ink ribbon 19 so that deterioration of the drawability of the ink ribbon 19 due to a decrease in the friction between the feed rollers 20, 21 and the ink ribbon 19 can be prevented. In addition, when a printing instruction is not released or the ink ribbon 19 is not in a traveling condition, the ink ribbon 19 is not heated unnecessarily, so that no damage will occur to the ink ribbon 19.

Figure 13:
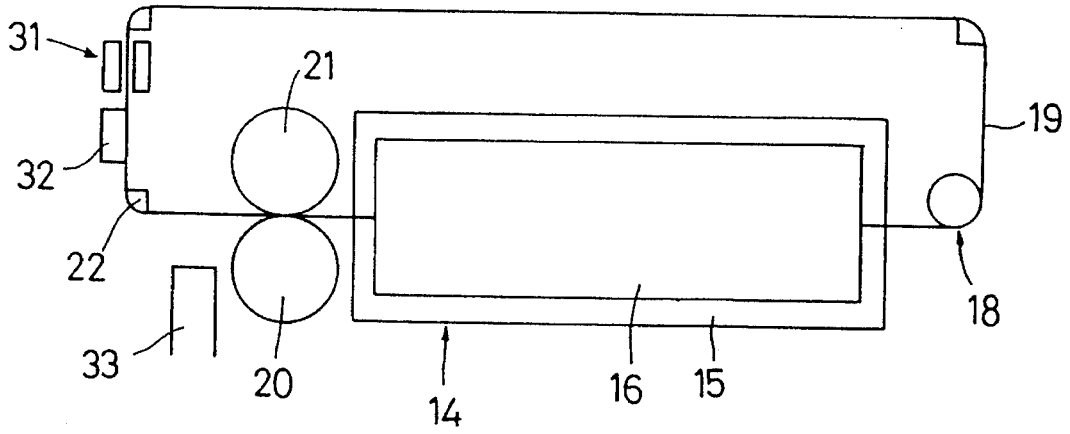

While the heater 30 embedded in the ribbon guide 22 is used in the foregoing embodiment, such a heater could be modified. For example, the following devices (see FIG. 13) can be employed satisfactorily as the means for heating the ink ribbon 19.

(1) Heating units 31 each composed of a thermistor for constant temperature heating elements are provided at both sides of the ink ribbon travel path in the upstream of the feed rollers 20, 21 in such a manner that the units 31 are kept out of contact with the ink ribbon 19.

(2) A heating unit 32 composed of a thermistor for constant temperature heating elements is provided in the ink ribbon travel path in the upstream of the feed rollers 20, 21 so as to come in contact with the ink ribbon 19.

Figure 18:
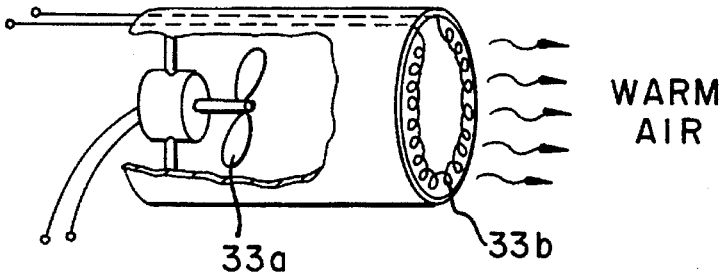
FIG. 18 PRIOR ART
FIG. 18 is a perspective view of the warm-air generating unit shown in FIG. 13.

(3) A warm-air generating unit 33 for heating the ink ribbon 19 is provided in the ink ribbon travel path in the upstream of the teed rollers 20, 21. As shown in FIG. 18, the warm-air generating unit 33 may be of well-known conventional design, containing a fan 33*a* and heater 33*b*.

Figure 14:
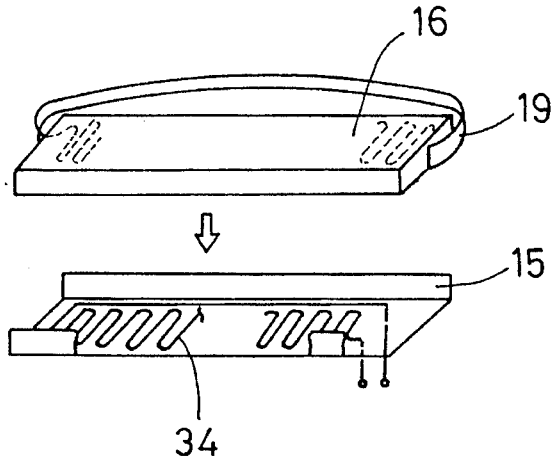

Another modification is shown in FIG. 14. In this example, a heater 34 is embedded in the ribbon case container 15 which comes in contact with the bottom of the ribbon case 16. The heater 34 heats the ink ribbon 19 through the ribbon case 16. The ink ribbon 19 is not directly heated in this example, so that there is no need to switch the heater 34 on or off according to whether or not the ink ribbon 19 is in a traveling condition as stated in the explanation of Step 3 in FIG. 12. Therefore, the heater 34 may be designed to be turned on whenever a printing instruction is released.

Alternatively, the heater 34 may be turned on irrespective of the presence of a printing instruction whenever the power switch is turned on.

Figure 15:
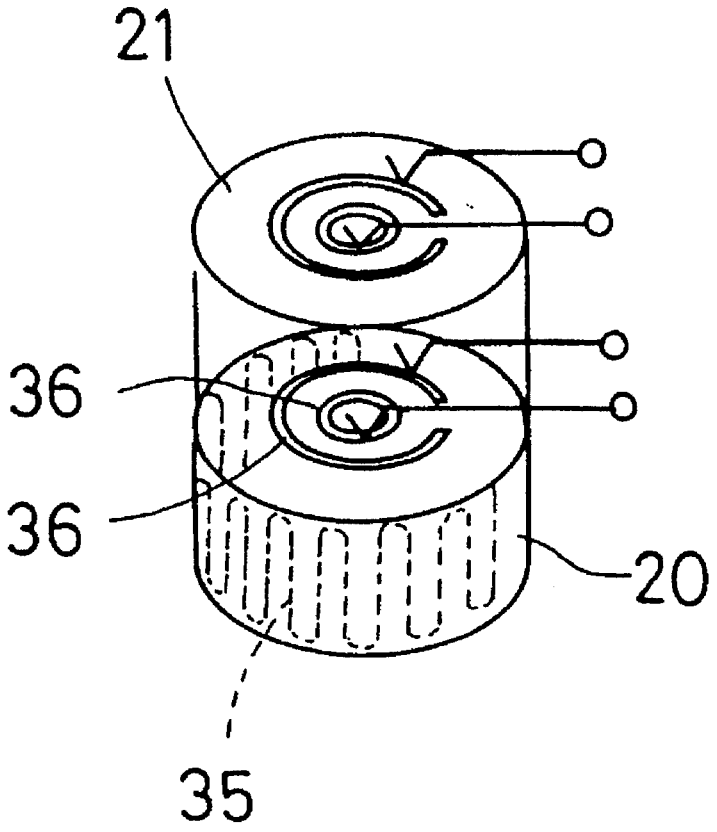
Figure 16:
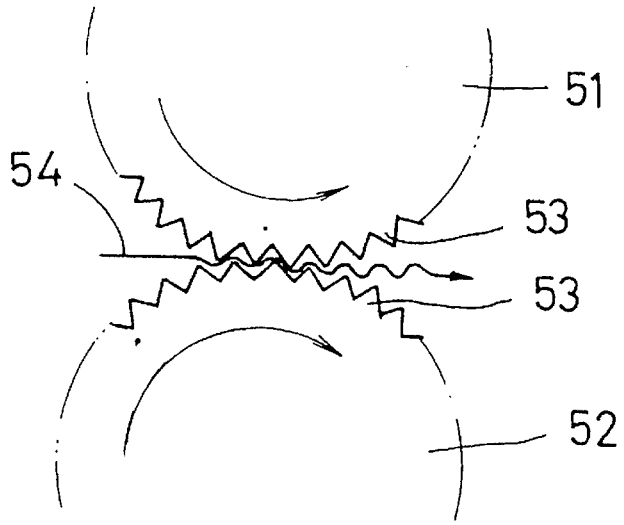
PRIOR ART FIG. 16

FIG. 15 shows a further modification. In this example, a heater 35 is embedded in or attached to both of the feed rollers 20, 21, and the end faces of the feed rollers 20, 21 are provided with ring-shaped contacts 36 for supplying electric current to the heater 35. With such arrangement, not only the ink ribbon 16 but also the feed rollers 20, 21 are heated and therefore inadequate folding of the ink ribbon 19 caused by hardening of the feed rollers 20, 21 can be more securely prevented. It is also possible to provide the heater 35 in either of the feed rollers 20, 21.

The above heating means may be used alone or a plurality of heating means may be used in combination.

It is apparent that the second embodiment is applicable to a ribbon cassette in which the feed rollers 20, 21 are incorporated.

The invention may be embodied by employing the arrangement of the first embodiment in combination with the arrangement of the second embodiment. In such an embodiment, the compactness (foldability) of the ink ribbon 19 to be accommodated in the ribbon case 16 can be further improved by the synergistic effects of the first and second embodiments.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink ribbon mechanism comprising a pair of feed rollers for sending a loop of ink ribbon into a ribbon case, wherein the pair of feed rollers have a plurality of grooves on the circumferential faces thereof, each said groove has a width less than a width of each of the circumferential face portions between successive grooves, and wherein the feed rollers contact each other only at their respective circumferential face portions between successive grooves with the ink ribbon therebetween.

2. The ink ribbon mechanism as recited in claim 1, wherein the feed rollers are formed by laminating a number of rolled bodies made from elastic material and the grooves are formed on all of the rolled bodies.

3. The ink ribbon mechanism as recited in claim 1 or 2, wherein each groove is formed so as to extend in an axial direction of the feed rollers.

4. An ink ribbon mechanism as recited in claim 1, further comprising heating means disposed in a travel path for the ink ribbon, for heating the ink ribbon to prevent deterioration of the drawability of the ink ribbon drawn by the pair of feed rollers.

5. The ink ribbon mechanism as recited in claim 4, further comprising temperature detecting means for detecting temperature in the vicinity of the travel path for the ink ribbon and heat controlling means for actuating the heating means when the temperature detected by the temperature detecting means is below a preset value.

6. The ink ribbon mechanism as recited in claim 4, further comprising a ribbon guide disposed in the travel path for the ink ribbon for guiding the ink ribbon, wherein the heating means consists of a heater incorporated in said ribbon guide.

7. The ink ribbon mechanism as recited in claim 4, wherein the heating means consists of a heating unit that is disposed along the travel path for the ink ribbon so as to come in contact with the ink ribbon.

8. The ink ribbon mechanism as recited in claim 4, wherein the heating means consists of a heating unit that is disposed along the travel path for the ink ribbon so as to heat atmospheric air in the vicinity of the ink ribbon.

9. The ink ribbon mechanism as recited in claim 4, wherein the heating means consists of a warm-air generating unit that is disposed along the travel path for the ink ribbon so as to blow warm air to the ink ribbon.

10. The ink ribbon mechanism as recited in claim 4, further comprising a ribbon case container for supporting the ribbon case, wherein the heating means consists of a heater incorporated in said ribbon case container.

11. The ink ribbon mechanism as recited in claim 4, wherein the heating means consists of one or more heaters incorporated in the pair of feed rollers.

* * * * *